US005409405A

United States Patent [19]

Bungo

[11] Patent Number: 5,409,405

[45] Date of Patent: Apr. 25, 1995

[54] PULL-TO-SEAT TERMINAL COLLAR

[75] Inventor: Edward M. Bungo, Cortland, Ohio

[73] Assignee: General Motors Corporation, Detroit, Mich.

[21] Appl. No.: 182,472

[22] Filed: Jan. 18, 1994

[51] Int. Cl.[6] ..... H01R 13/426

[52] U.S. Cl. ..... 439/752; 439/745

[58] Field of Search ..... 439/752, 750, 745, 701, 439/712, 598, 78

[56] References Cited

U.S. PATENT DOCUMENTS

| | | | |
|---|---|---|---|
| 4,565,416 | 1/1986 | Rudy et al. | 439/701 X |
| 4,871,320 | 10/1989 | Biouissie | 439/598 X |
| 5,252,092 | 10/1993 | Reider et al. | 439/595 |
| 5,342,223 | 8/1994 | Geib | 439/752 |

*Primary Examiner*—Eugene F. Desmond

*Attorney, Agent, or Firm*—William A. Schuetz

[57] ABSTRACT

A connector assembly comprises a connector body having a plurality of cavities extending from a rearward conductor end to an intermediate location and an enlarged common opening along its forward end from the intermediate location to a forward end and with the intermediate location defining a transverse shoulder. It further comprises cylindrically shaped metal terminals having lands and each connected to a conductor. The terminals are inserted through the connector body and attach to a deflectable collar whose cross-sectional shape is like that of the common opening. The terminals are snap fittingly attached to the collar and then simultaneously pulled to seat via the lands on the collar engaging a shoulder on the collar and sliding the collar through the common opening of the connector body until the collar engages the transverse shoulder therein.

7 Claims, 2 Drawing Sheets

PULL-TO-SEAT TERMINAL COLLAR

The present invention relates to an electrical connector assembly and, more particularly, to an electrical connector assembly in which a plurality of terminals are connected to a collar and simultaneously pulled to seat within a connector housing.

Electrical connector assemblies with pull-to-seat terminals have been previously produced. In these assemblies, a connector body is provided with a plurality of terminal receiving cavities extending therethrough through which terminals connected to conductors can be pushed through. Each of the cavities was defined in part by a deflectable part or finger which was deflected outwardly when the associated terminal was being pushed through the connector body. The fingers had a lock shoulder which was engaged by a land on the terminal when the latter was pulled rearwardly to seat the terminal. Thereafter a terminal position assurance member or cap was connected to the connector body to assure that the terminals were all properly seated. U.S. Pat. No. 5,252,092, assigned to the same assignee as the present invention, shows such a connector assembly.

While the above-noted pulled-to-seat connector assemblies have been successful in use, they, nevertheless, required that individual deflectable fingers for each terminal be provided. This results in the need for more complex molds, more costly molds and requires that close tolerance limitations be held.

In accordance with the provisions of the present invention, a connector assembly having pull-to-seat terminals is provided which is of a simpler construction, requires a less complex mold and in which a plurality of terminals can be pulled-to-seat simultaneously. This is accomplished by providing a connector body having a plurality of connector cavities extending from a rearward conductor end to an intermediate location and an enlarged common opening along its forward end portion which extends from the intermediate location to a forward contact end and with the intermediate location defining a transversely extending shoulder surface. A cylindrically shaped metal terminal having a radially extending land and connected to a conductor is inserted through each of the cavities from the rearward conductor end of the connector body and pushed through the common opening and past the forward contact end. The terminals are then attached to a plastic deflectable collar whose overall cross sectional shape is substantially identical to the common opening in the connector body.

The collar is provided with an axially extending stepped through opening for each terminal to define a shoulder and a transverse slot of a lesser dimension than the diameter of the terminal to enable the terminal to be snap fittingly connected thereto. The terminals, after each is connected to the collar, are then simultaneously pulled-to-seat by the lands engaging the shoulder in the collar and sliding the collar through the common opening of the connector body until the collar engages the shoulder surface in the connector body. A terminal position assurance member or cap is preferably provided and connected to the connector body to ensure that all of the terminals have been properly seated.

The present invention further resides in various novel constructions and arrangement of parts, and further novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
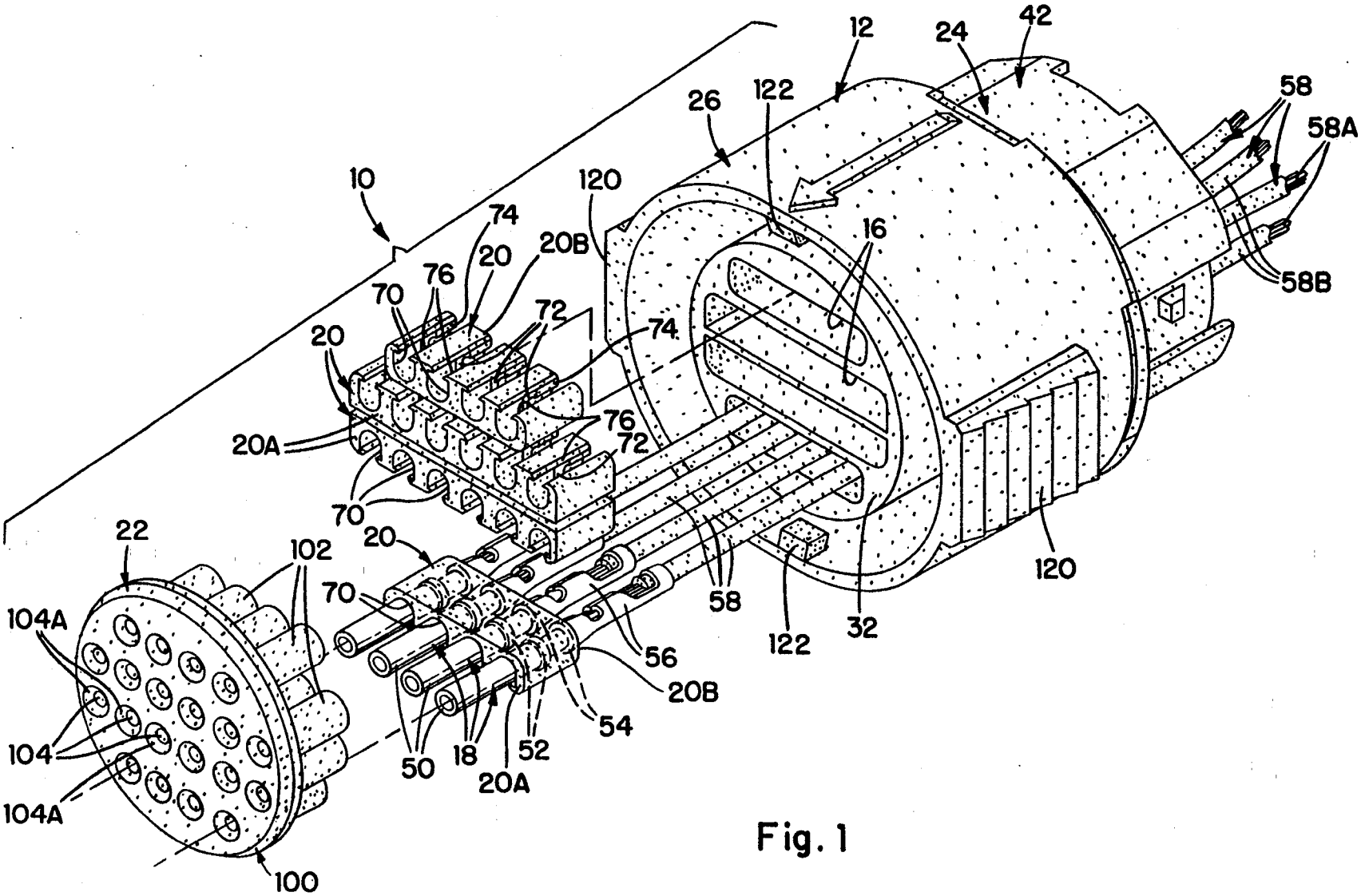
FIG. 1 is an exploded, perspective view of an electrical connector assembly embodying the present invention.

Referring to the drawings, an electrical connector assembly 10 is thereshown. The electrical connector assembly 10 comprises, in general, a connector body 12 having rows of individual connector cavities 14 extending along its rearward portion, enlarged common openings 16 extending along its forward portion which communicate with one of the rows of the individual cavities 14, a plurality of rows of metal terminals 18 which extend through the openings 14 and into one of the common openings 16, deflectable collars 20 which are secured to one of the rows of terminals 18 and with the collars 20 pulling all of the terminals 18 in each row connected thereto simultaneously rearwardly to seat when the collars 20 are slidably are received within their associated common opening 16 until it hits seat 21 at the juncture of the rows of cavities and common openings 16; and a terminal position assurance member 22 which is connectable to the connector body 12 and which assures that all of the terminals 18 have been properly seated.

Figure 2:
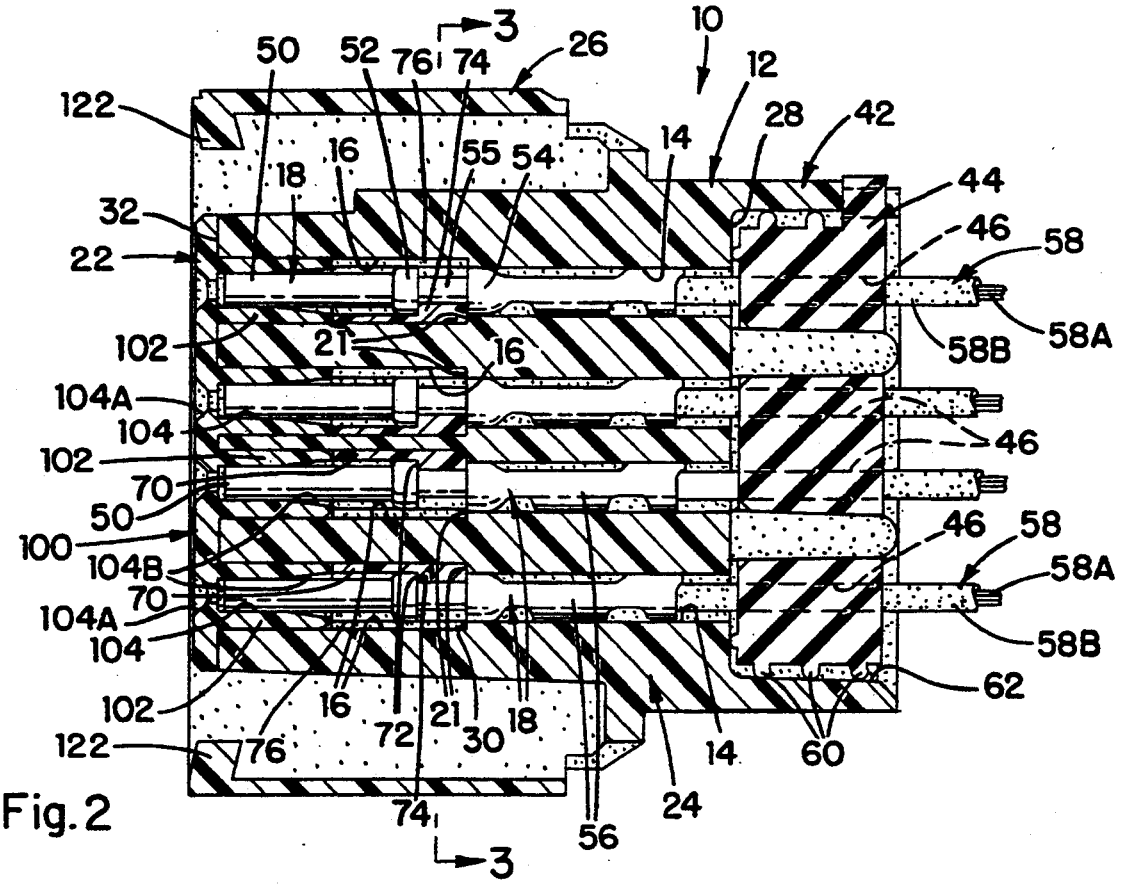
FIG. 2 is an axial, cross sectional view of the electrical connector assembly shown in FIG. 1 and with all of the parts thereof connected together.
Figure 3:
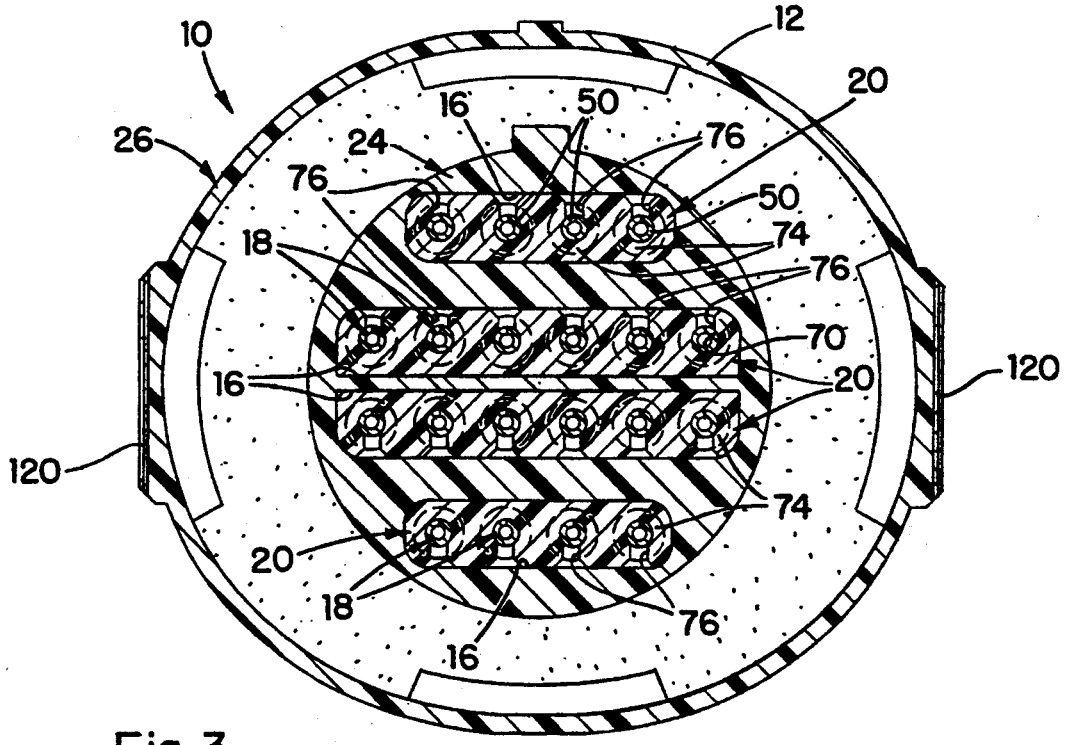
FIG. 3 is a cross sectional view taken approximately along line 3—3 of FIG. 2.

The connector body 12 is made from a suitable electrically insulated material and comprises a main central body portion 24 and an outer radially spaced shroud portion 26. The cavities 14 for each row of cavities in the connector body portion 24 extend from a rearward connector end 28 to an intermediate location 30. The cavities 14 of each row and the rows of cavities are spaced from each other and each cavity 14 is adapted to receive an individual terminal 18. The common openings 16 for each row of cavities extends from the intermediate location 30 to a forward contact end 32. Each of the common openings 16 communicates with the individual terminal cavities 14 of its aligned row of cavities and are generally rectangular in shape, as best shown in FIGS. 1 and 3. As best shown in FIG. 2, the common openings 16 also have a larger transverse dimension than the individual cavities 14 so as to define a transversely or perpendicularly extending shoulder surface or seat 21 at the intermediate location 30 which faces toward the forward contact end 32.

The connector body 12 as best shown in FIG. 2, is also provided with a rearwardly extending cap or cap portion 42 at its rearward end which slidably receives a seal 44 having a plurality of openings 46 therethrough which are aligned with the terminal cavities 14, and for a reason to be hereafter more fully described.

The terminals 18 could be of any suitable or convention construction, but are preferably metal cylindrical socket type terminals having a forward socket portion 50, a pair of spaced, radially extending lands 52, 54 defining an annular groove 55 and a rearward crimping portion 56 for crimping the terminals 18 onto a core **58*a* and an insulated sheath 58*b* of an electrical cable or conductor 58. Each of the terminals 18 and its associated conductor 58 are inserted from the rearward conductor end 28 of the connector body 12 through an opening 46 in the seal 44, into the cavity 14 and through the common opening 16 associated with that cavity and out past the forward contact end 32 of the connector body 12. The seal 44 snugly engages the insulated sheath 58***b* of the conductors 58 to provide for a seal between the connector body 12 and the conductors 58. The seal 44 also has annular radially extending ribs 60 for sealingly engaging an annular inner surface 62 of the cap portion 42 at the rearward end of the connector body 12. It should be obvious that the terminals 18 could be cylindrical pin terminals provided with a pair of spaced lands rather than a cylindrical socket terminal for receiving a mating pin terminal, as shown.

As shown in FIG. 1, each of the collars 20 is adapted to be connected to a plurality of terminals 18 and each of the collars 20 is shaped overall so as to be complementary with the shape of its associated common opening 16. That is, the collars 20 each have a cross sectional shape which is substantially similar to the cross sectional shape of the openings 16 into which they are adapted to be slidably received. The collars 20 are made from a suitable plastic or deflectable material and are provided with a plurality of axially extending stepped through openings 70 therethrough. The stepped configuration of each opening 70 defines a radially extending shoulder 72 intermediate the forward and rearward ends 20A, 20B of the collar 20 which faces toward the forward end of the collar 20 and the forward contact end 32 of the connector body 12 when received therein. As best shown in FIGS. 1 and 2, the stepped configuration provides the collar 20 with a rearward radially inwardly and arcuately extending projection 74 which is received in the groove 55 between the lands 52, 54 of the terminal 18.

The collar 20 also has transverse slots 76 therethrough in communication with the central through opening 70. The slots 76 have a width which is less than the diameter of the socket portions 50 of the socket terminals 18. The terminals 18 are connected to the collars 20 by pushing the socket portion 50 and land 52 of each terminal 18 through a transverse slot 76 into the axial through opening 70. The terminals 18 are thus snap fittingly connected to the collars 20 and with the projections 74 on the collar 20 being received between the lands 52, 54 of the terminals 18. When the terminals 18 have all been connected to their respective collar 20, the conductors 58 can be pulled rearwardly and with collar 20 slidably being received within the associated common opening 16. This rearward movement continues as a result of the engagement by the land 52 against the shoulder 72 in the collar 20 until the collar 20 engages the transversely extending shoulder or seat surface 21 in the connector body 12 whereby a plurality of pin terminals 18 are all simultaneously pulled-to-seat at the same time.

The collars 20 could either be manually assembled to the individual terminals 18 and associated conductors 58 or they could be connected thereto via a suitable automated assembly apparatus which pushes the terminals 18 into the collar 20. It should thus be apparent that by the use of a collar 20 for a plurality of terminals 18, that the time required for pulling the terminals 18 to seat is reduced over having to do it individually. Also, the collars 20 serve to insulate the terminals 18 from one another since it is made from an electrically insulated material.

The terminal position assurance member or cap 22 is made from a suitable plastic material and comprises a circular end 100 and rows of a plurality of rearwardly extending towers or sockets 102 which are adapted to be received with the common openings 16 in the connector body 12. The terminal position assurance member 22 also has a plurality of openings 104 extending therethrough. The forward ends of the openings 104 are beveled, as indicated by reference numeral 104A, so as to guide a mating pin terminal on a mating connector body (not shown) through the openings 104. The openings 104 have a diameter along their rearward end portions which is slightly larger than the diameter of the socket portions 50 of the terminals 18 and are also beveled at their rearward ends, as indicated by reference numeral 104B, to serve so as to guide for receiving the socket portions 50 of the metal terminals 18 into the openings 104. The terminal position assurance member is positioned so that its sockets 102 receive the individual socket portions 50 of the terminals 18 until the rearward end of the rows of sockets 102 engages the forward end faces 20*a* of the collars 20. When this occurs, the circular end cap will also engage the forward contact end 32 of the connector body 12. This assures that all of the socket terminals 18 have been properly seated by the collars 20 within the connector body 12 and that there is no misalignment, since the cap 22 could not be connected if the terminals 18 were not properly seated.

The connector body 12 is adapted to be connected to a mating connector body carrying a plurality of mating pin terminals (not shown). To this end, the shroud has a pair of finger gripping portions 120 at diametrical opposite locations so that it can be squeezed by hand to change the configuration from a somewhat oval shape to a round shape to enable it to be mated to a mating connector body (not shown) via inwardly extending projections 122 engaging suitable attachment portions on the mating connector (not shown).

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed is defined as follows:

1. An electrical connector assembly comprising:

a connector body molded from an electrically insulating material and having at least one cavity extending axially through the connector body from a rearward conductor end to a forward contact end, said cavity along its forward portion having a greater transverse dimension than along its rearward portion to define a transversely extending shoulder facing toward said forward end of said connector body, a metal cylindrical terminal which is attached to an insulated electrical conductor and which is disposed in said cavity with the insulated conductor extending out of the rear conductor end of the connector body, said terminal having a radially extending land and being insertable through said cavity and past the forward contact end, a collar having an axially extending opening therethrough and a transverse slot communicating with said axially extending opening, and which slot has a width less than the diameter of said cylindrical terminal, said terminal being attachable to the collar by pushing the same through the transverse slot in said collar until it seats within said axial opening of said collar and said land of said terminal engages a transverse surface on said collar, said terminal being seatable in said connector body by pulling said conductor rearwardly until said collar engages said shoulder and said land seats against said transverse surface on the collar.

2. An electrical connector assembly comprising:

a connector body molded from an electrically insulating material and having a row of spaced apart cavities extending axially through the connector body from a rearward conductor end to an intermediate location in the connector body, said connector body having an enlarged common opening along its forward portion which extends from said intermediate location to a forward connector end and which communicates with each of said cavities, said intermediate location defining a transversely extending shoulder surface on the connector body facing toward said forward connector end of said connector body, metal cylindrical terminals each of which is attached to an insulated electrical conductor and which is disposed in one of said cavities with the insulated conductor extending out of the rear conductor end of the connector body, said terminals having a radially extending land and being insertable through said cavities, said common opening and past the forward contact end, a collar whose overall cross sectional shape is substantially like that of the common opening and which is slidably receivable in said common opening, said collar having spaced axially extending openings therethrough and transverse slots communicating with each of said axially extending openings, said slots having a width less than said cylindrical terminals diameter, said terminals each being attachable to the collar by pushing the same through a transverse slot in said collar until it seats within its adjacently located axial opening of said collar and said land of said terminal engages a transverse abutment surface on said collar, said terminals being simultaneously seatable in said connector body by pulling said conductors rearwardly until said collar engages said shoulder in the connector body and said lands seat against said transverse abutment surface on the collar.

3. An electrical connector assembly comprising:

a connector body molded from an electrically insulating material and having spaced rows of individually spaced apart cavities extending axially through the connector body from a rearward conductor end to an intermediate location in the connector body, said connector body having enlarged common openings along its forward portion which extend from said intermediate location of each row to a forward connector end and with each common opening communicating with each of said cavities in one of said rows of cavities, said intermediate location for each row defining a transversely extending shoulder surface on the connector body facing toward said forward connector end of said connector body, metal cylindrical terminals each of which is attached to an insulated electrical conductor and which is disposed in one of said cavities with the insulated conductor extending out of the rear conductor end of the connector body, said terminals each having a radially extending land and being insertable through a cavity in one of said rows of cavities, said common opening aligned with said cavity and past the forward contact end, collars whose overall cross sectional shape is substantially like that of the common openings and which are slidably receivable in said common openings, said collars having spaced axially extending stepped openings therethrough and transverse slots communicating with said axially extending openings, said slots having a width less than said cylindrical terminals diameter and said stepped axial opening each defining a radially extending shoulder facing toward the contact end of the connector body, said terminals each being attachable to the collar by pushing the same at a location rearwardly of its land through a transverse slot in said collar and with the land being located forwardly of said shoulder in said collar until it seats within its adjacently located axial opening of said collar, said terminals connected to each collar being simultaneously seatable in said connector body by pulling said conductors rearwardly until said collar engages said shoulder at the intermediate location of said connector body and said lands of the terminals seat against the shoulders in said collar.

4. An electrical connector assembly, as defined in claim 2, and wherein said axially extending openings in said collar are stepped intermediate its opposite ends to define an arcuate and radially inwardly extending portion and a shoulder facing toward the forward contact end of the connector body and wherein said lands on said terminals engage said shoulders on said collars when the terminals are pulled to seat.

5. An electrical connector assembly as defined in claim 4 and wherein said collar has a forward end portion which surrounds said forward portions of said terminals, said collar serving to electrically insulate the terminals from each other.

6. An electrical connector assembly, as defined in claim 5, and including a terminal position assurance member engageable with the forward contact end of the connector body and the collar at its forward end, the terminal position assurance member having a plurality of through openings for receiving forward end portions of the terminals.

7. An electrical connector assembly, as defined in claim 5 and wherein said terminals have a pair of spaced lands which define an annular groove for receiving the arcuate and radially inwardly extending portion of said collar.

* * * * *